US010760178B2

(12) United States Patent
Banik, II et al.

(10) Patent No.: US 10,760,178 B2
(45) Date of Patent: Sep. 1, 2020

(54) METHOD AND APPARATUS FOR SYNCHRONIZED PRESSURE REGULATION OF SEPARATED ANODE CHAMBER

(71) Applicant: Lam Research Corporation, Fremont, CA (US)

(72) Inventors: Stephen J. Banik, II, Portland, OR (US); Bryan L. Buckalew, Tualatin, OR (US); Frederick Dean Wilmot, Gladstone, OR (US); Robert Rash, West Linn, OR (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 16/033,839

(22) Filed: Jul. 12, 2018

(65) Prior Publication Data

US 2020/0017989 A1 Jan. 16, 2020

(51) Int. Cl.

| | |
|---|---|
| ***C25B 9/08*** | (2006.01) |
| ***C25B 9/10*** | (2006.01) |
| ***C25B 15/08*** | (2006.01) |
| ***C25D 21/14*** | (2006.01) |
| ***C25D 17/00*** | (2006.01) |
| ***C25D 21/04*** | (2006.01) |

(52) U.S. Cl.

CPC ..... *C25D 21/14* (2013.01); *C25D 17/00* (2013.01); *C25D 21/04* (2013.01)

(58) Field of Classification Search

CPC .. C25B 9/08; C25B 15/08; C25B 9/10; C25B 1/10; C25B 9/00; C25B 9/18; C25B 9/02

See application file for complete search history.

(56) References Cited

U.S. PATENT DOCUMENTS

| | | | |
|---|---|---|---|
| 4,003,263 | A | 1/1977 | O'Rourke |
| 4,767,526 | A | 8/1988 | Vantard |
| 5,456,756 | A | 10/1995 | Ramaswami et al. |
| 6,126,798 | A | 10/2000 | Reid et al. |
| 6,156,167 | A | 12/2000 | Patton et al. |
| 6,254,742 | B1 | 7/2001 | Hanson et al. |
| 6,368,475 | B1 | 4/2002 | Hanson et al. |

(Continued)

FOREIGN PATENT DOCUMENTS

| | | | |
|---|---|---|---|
| JP | 2005-133187 | A | 5/2005 |
| JP | 2007-525595 | A | 9/2007 |

(Continued)

OTHER PUBLICATIONS

U.S. Office Action, dated Dec. 31, 2012, issued in U.S. Appl. No. 13/051,822.

(Continued)

*Primary Examiner* — Zulmariam Mendez

(74) *Attorney, Agent, or Firm* — Weaver Austin Villeneuve & Sampson LLP

(57) ABSTRACT

Electroplating results can be improved by dynamically controlling the pressure in different parts of an electroplating apparatus. For example, a number of plating problems can be avoided by ensuring that the pressure in an anode chamber always remains slightly above the pressure in an ionically resistive element manifold, both during electroplating and during non-electroplating operations. This pressure differential prevents the membrane from stretching downward into the anode chamber.

20 Claims, 9 Drawing Sheets

(56) References Cited

U.S. PATENT DOCUMENTS

| | | | | |
|---|---|---|---|---|
| 6,454,927 | B1 | 9/2002 | Stevens et al. | |
| 6,527,920 | B1 | 3/2003 | Mayer et al. | |
| 6,551,487 | B1 | 4/2003 | Reid et al. | |
| 6,569,299 | B1 | 5/2003 | Reid et al. | |
| 6,800,187 | B1 | 10/2004 | Reid et al. | |
| 6,821,407 | B1 | 11/2004 | Reid et al. | |
| 6,890,416 | B1 | 5/2005 | Mayer et al. | |
| 7,622,024 | B1 | 11/2009 | Mayer et al. | |
| 8,128,791 | B1 | 3/2012 | Buckalew et al. | |
| 8,262,871 | B1 | 9/2012 | Mayer et al. | |
| 8,603,305 | B2 | 12/2013 | Rash et al. | |
| 9,139,927 | B2 | 9/2015 | Rash et al. | |
| 2002/0027080 | A1 | 3/2002 | Yoskioka et al. | |
| 2011/0226614 | A1 | 9/2011 | Rash et al. | |
| 2013/0334052 | A1 | 12/2013 | Chua et al. | |
| 2014/0131211 | A1 | 5/2014 | Rash et al. | |
| 2014/0183049 | A1* | 7/2014 | Mayer | C25D 17/002 205/133 |
| 2016/0215408 | A1 | 7/2016 | Kagajwala et al. | |
| 2016/0265132 | A1 | 9/2016 | Graham et al. | |
| 2017/0342583 | A1 | 11/2017 | Thorkelsson et al. | |

FOREIGN PATENT DOCUMENTS

| | | | |
|---|---|---|---|
| KR | 10-2001-0090469 | A | 10/2001 |
| KR | 10-2016-0122076 | A | 10/2016 |
| KR | 10-1723991 | B1 | 4/2017 |
| TW | I281516 | | 5/2007 |
| WO | WO 2005/076977 | A2 | 8/2005 |

OTHER PUBLICATIONS

U.S. Office Action, dated May 7, 2013, issued in U.S. Appl. No. 13/051,822.

U.S. Notice of Allowance, dated Aug. 7, 2013, issued in U.S. Appl. No. 13/051,822.

U.S. Office Action, dated Jan. 16, 2015, issued in U.S. Appl. No. 14/074,510.

U.S. Notice of Allowance, dated Jun. 3, 2015, issued in U.S. Appl. No. 14/074,510.

Chinese First Office Action dated Aug. 5, 2014 issued in Application No. CN 201110071633.8.

Chinese Second Office Action dated Mar. 20, 2015 issued in Application No. CN 201110071633.8.

Chinese First Office Action dated Jan. 4, 2017 issued in Application No. CN 201510623134.3.

Korean First Office Action dated Dec. 12, 2016 issued in Application No. KR 10-2011-0024686.

Korean Second Office Action dated Jun. 27, 2017 issued in Application No. KR 10-2011-0024686.

Taiwan First Office Action and Search Report dated Jan. 13, 2015 issued in Application No. TW 100109635.

Taiwan Office Action and Search Report dated May 2, 2016 issued in Application No. TW 104119312.

Patton, et al. "U.S. Appl. No. 09/872,340, filed May 31, 2001", incorporated by reference in its entirety by Reid et al (U.S. Pat. No. 6,551,487).

International Search Report and Written Opinion dated Oct. 24, 2019 issued in Application No. PCT/US2019/041312.

* cited by examiner

METHOD AND APPARATUS FOR SYNCHRONIZED PRESSURE REGULATION OF SEPARATED ANODE CHAMBER

FIELD

Embodiments herein relate to methods and apparatus for electroplating material onto substrates. The substrates are typically semiconductor substrates and the material is typically metal.

BACKGROUND

The disclosed embodiments relate to methods and apparatus for controlling electrolyte hydrodynamics during electroplating. More particularly, methods and apparatus described herein are particularly useful for plating metals onto semiconductor wafer substrates, such as through resist plating of small microbumping features (e.g., copper, nickel, tin and tin alloy solders) having widths less than, e.g., about 50 μm, and copper through silicon via (TSV) features.

Electrochemical deposition is now poised to fill a commercial need for sophisticated packaging and multichip interconnection technologies known generally and colloquially as wafer level packaging (WLP) and through silicon via (TSV) electrical connection technology. These technologies present their own very significant challenges due in part to the generally larger feature sizes (compared to Front End of Line (FEOL) interconnects) and high aspect ratios.

Depending on the type and application of the packaging features (e.g., through chip connecting TSV, interconnection redistribution wiring, or chip to board or chip bonding, such as flip-chip pillars), plated features are usually, in current technology, greater than about 2 micrometers and are typically about 5-100 micrometers in their principal dimension (for example, copper pillars may be about 50 micrometers). For some on-chip structures such as power busses, the feature to be plated may be larger than 100 micrometers. The aspect ratios of the WLP features are typically about 1:1 (height to width) or lower, though they can range as high as perhaps about 2:1 or so, while TSV structures can have very high aspect ratios (e.g., in the neighborhood of about 20:1).

The background description provided herein is for the purposes of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

Certain embodiments herein relate to methods and apparatus for electroplating material onto semiconductor substrates. Generally, the techniques described herein involve dynamically controlling pressure in different regions of an electroplating apparatus in order to achieve synchronized pressure regulation. Typically, the pressure in an anode chamber is controlled to be slightly higher than the pressure in an ionically resistive element manifold.

In one aspect of the embodiments herein, a method of dynamically controlling pressure in an electroplating apparatus is provided, the method including: (a) receiving a substrate in the electroplating apparatus, the electroplating apparatus including: a plating chamber configured to contain an electrolyte and an anode while electroplating metal onto the substrate, the substrate being substantially planar, a substrate support configured to support the substrate such that a plating face of the substrate is immersed in the electrolyte and separated from the anode during plating, an ionically resistive element adapted to provide ionic transport through the ionically resistive element during electroplating, where the ionically resistive element is a plate including a plurality of through-holes, a membrane adapted to provide ionic transport through the membrane during electroplating, an ionically resistive element manifold positioned below the ionically resistive element and above the membrane, and an anode chamber positioned below the membrane and containing the anode; (b) immersing the substrate in the electrolyte and electroplating material onto the substrate; (c) removing the substrate from the plating chamber; and (d) during (a)-(c), dynamically controlling a pressure in the anode chamber such that the pressure in the anode chamber is always between about 690-6900 Pascal higher than a pressure in the ionically resistive element manifold.

In various implementations, the pressure in the anode chamber may be higher when electroplating material onto the substrate in (b) compared to when loading or unloading the substrate in (a) or (c). In some such cases, (i) during (a) and (c), the pressure in the anode chamber may be between about 690-2070 Pascal and the pressure in the ionically resistive element manifold may be between about 0-1380 Pascal, and (ii) during (b) when the substrate is being electroplated, the pressure in the anode chamber may be between about 1380-4830 Pascal and the pressure in the ionically resistive element manifold may be between about 690-4140 Pascal.

In certain embodiments, the pressure in the anode chamber may be dynamically controlled by varying a flow rate of electrolyte into the anode chamber. For example, during (a) and (c), a flow rate of electrolyte through a pump that feeds the anode chamber may be between about 0.3-2.0 L/min, and during (b) when the substrate is being electroplated, the flow rate of electrolyte through the pump that feeds the anode chamber may be between about 1.0-4.0 L/min. In these or other embodiments, the flow rate of electrolyte into the anode chamber may be dynamically controlled based on a position of the substrate support. In some embodiments, the electroplating apparatus may further include a first pressure sensor for determining a pressure in the anode chamber and a second pressure sensor for determining a pressure in the ionically resistive element manifold, and the flow rate of electrolyte into the anode chamber may be dynamically controlled based a difference between the pressure in the anode chamber determined by the first pressure sensor and the pressure in the ionically resistive element manifold determined by the second pressure sensor.

In some embodiments, the pressure in the anode chamber may be dynamically controlled by varying a restriction on electrolyte leaving the anode chamber. For example, the restriction on electrolyte leaving the anode chamber may be varied by dynamically controlling a position of a valve that affects the electrolyte leaving the anode chamber.

In various implementations, during (a)-(c), the pressure in the anode chamber may be between about 690-1380 Pascal higher than a pressure in the ionically resistive element manifold.

In another aspect of the embodiments herein, an apparatus for electroplating is provided, the apparatus including: a plating chamber configured to contain an electrolyte and an anode while electroplating metal onto a substrate, the substrate being substantially planar; a substrate support configured to support the substrate such that a plating face of the substrate is immersed in the electrolyte and separated from the anode during plating; an ionically resistive element adapted to provide ionic transport through the ionically resistive element during electroplating, where the ionically resistive element is a plate including a plurality of through-holes; a membrane adapted to provide ionic transport through the membrane during electroplating; an ionically resistive element manifold positioned below the ionically resistive element and above the membrane; an anode chamber positioned below the membrane and containing the anode; and a controller configured to cause dynamically controlling a pressure in the anode chamber when electrolyte is present in the anode chamber to thereby maintain the pressure in the anode chamber between about 690-6900 Pascal higher than a pressure in the ionically resistive element manifold.

In some embodiments, the controller may be configured to cause dynamically controlling the pressure in the anode chamber such that a first anode chamber pressure is established during electroplating and a second anode chamber pressure is established when the substrate is being loaded or unloaded from the substrate support, the first anode chamber pressure being greater than the second anode chamber pressure.

In some embodiments, the controller may be configured to cause a dynamic pressure in the ionically resistive element manifold, such that a first ionically resistive element manifold pressure is established during electroplating and a second ionically resistive element manifold pressure is established when the substrate is being loaded or unloaded from the substrate support, the first ionically resistive element manifold pressure being greater than the second ionically resistive element manifold pressure, where the first ionically resistive element manifold pressure is between about 690-4140 Pascal, the second ionically resistive element manifold pressure is between about 0-1380 Pascal, the first anode chamber pressure is between about 1380-4830 Pascal, and the second anode chamber pressure is between about 690-2070 Pascal.

In various implementations, the pressure in the anode chamber may be dynamically controlled by varying a flow rate of electrolyte into the anode chamber. In some such cases, the controller may be configured to cause an electrolyte flow rate through a pump feeding the anode chamber to be (i) between about 0.3-2.0 L/min when the substrate is being loaded or unloaded from the substrate support, and (ii) between 1.0-4.0 L/min during electroplating. In these or other implementations, the controller may be configured to dynamically control the flow rate of electrolyte into the anode chamber based on a position of the substrate support.

The apparatus may further include a first pressure sensor for determining the pressure in the anode chamber, and a second pressure sensor for determining the pressure in the ionically resistive element manifold, and the controller may be configured to dynamically control the flow rate of electrolyte into the anode chamber based on a difference between the pressure in the anode chamber determined by the first pressure sensor and the pressure in the ionically resistive element manifold determined by the second pressure sensor.

In some embodiments, the controller may be configured to dynamically control the pressure in the anode chamber by varying a restriction on electrolyte leaving the anode chamber. For example, the controller may vary the restriction on electrolyte leaving the anode chamber by controlling a position of a valve that affects the electrolyte leaving the anode chamber.

In various implementations, the controller may be configured to dynamically control the pressure in the anode chamber such that it remains between about 690-1380 Pascal higher than the pressure in the ionically resistive element manifold.

These and other features will be described below with reference to the associated drawings.

DETAILED DESCRIPTION

Figure 1A:
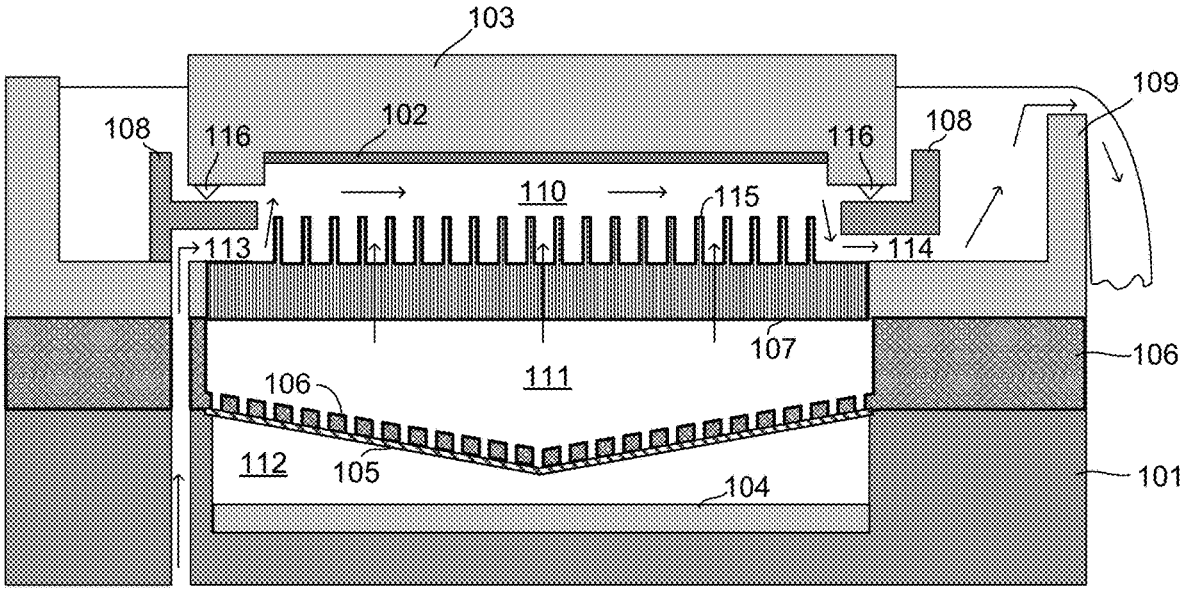
FIG. 1A illustrates an electroplating apparatus that utilizes a combination of cross flow and impinging flow on the substrate surface during electroplating.
Figure 1B:
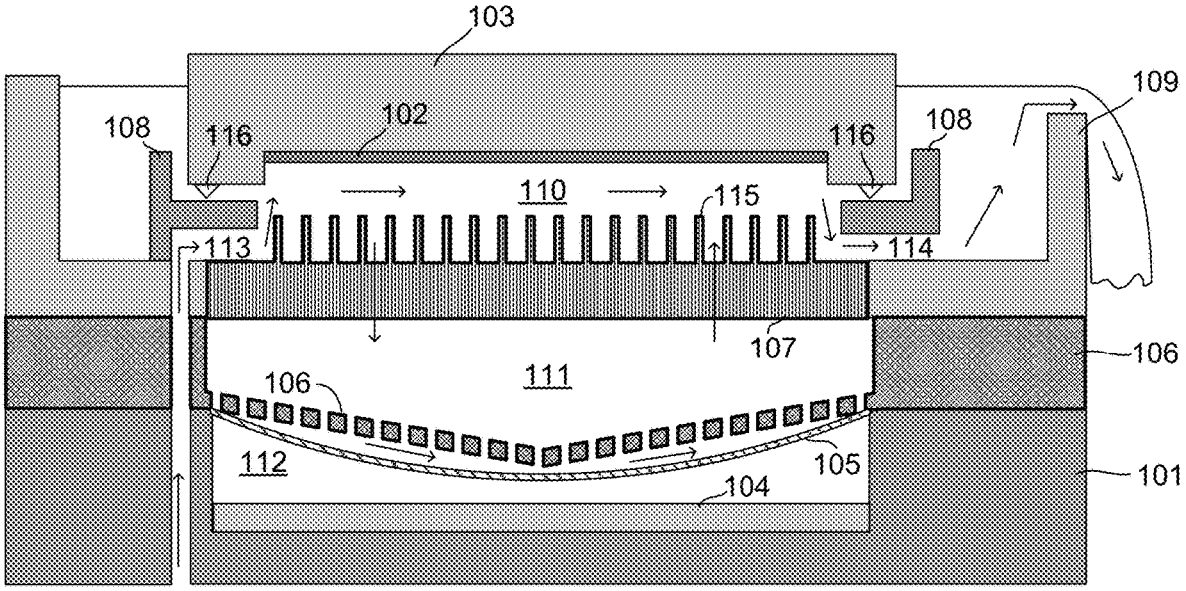
FIG. 1B depicts a problem related to membrane displacement that can arise in some cases when electroplating using the apparatus of FIG. 1A.

FIG. 1A depicts a simplified cross-sectional view of an electroplating apparatus. FIG. 1B shows the apparatus of FIG. 1A, specifically illustrating a pressure- and membrane-related problem that can arise during electroplating. The apparatus includes electroplating cell 101, with substrate 102 positioned in a substrate support 103. Substrate support 103 is often referred to as a cup, and it may support the substrate 102 at its periphery. An anode 104 is positioned near the bottom of the electroplating cell 101. The anode 104 is separated from the substrate 102 by a membrane 105, which is positioned below and supported by a membrane frame 106. Membrane frame 106 is sometimes referred to as an anode chamber membrane frame. Further, the anode 104 is separated from the substrate 102 by an ionically resistive element 107. The ionically resistive element 107 includes openings that allow electrolyte to travel through the ionically resistive element 107 to impinge upon the substrate 102. A front side insert 108 is positioned above the ionically resistive element 107, proximate the periphery of the substrate 102. The front side insert 108 may be arc-shaped or ring-shaped, and may be azimuthally non-uniform, as shown. The front side insert 108 is sometimes also referred to as a cross flow confinement ring. A ring-shaped or arc-shaped sealing member 116 is provided between the front side insert 108 and the substrate support 103.

An anode chamber 112 is below the membrane 105, and is where the anode 104 is located. An ionically resistive element manifold 111 is above the membrane 105 and below the ionically resistive element 107. A cross flow manifold 110 is above the ionically resistive element 107 and below the substrate 102. The height of the cross flow manifold is considered to be the distance between the substrate 102 and the plane of the ionically resistive element 107 (excluding the ribs on the upper surface of the ionically resistive element 107, if present). In some cases, the cross flow manifold may have a height between about 1 mm-4 mm, or between about 0.5 mm-15 mm. The cross flow manifold 110 is defined on its sides by the front side insert 108, which acts to contain the cross flowing electrolyte within the cross flow manifold 110. A side inlet 113 to the cross flow manifold 110 is provided azimuthally opposite a side outlet 114 to the cross flow manifold 110. The side inlet 113 and side outlet 114 may be formed, at least partially, by the front side insert 108. The sealing member 116 provides a seal between the front side insert 108 and the substrate support 103, thereby ensuring that electrolyte only exits the cross flow manifold 110 at the side outlet 114 when the sealing member 116 is engaged. In various cases the sealing member 116 may be integral with the cross flow confinement ring 108, or with the substrate support 103, or it may be provided as a separate unit.

As shown by the arrows in FIG. 1A, electrolyte travels through the side inlet 113, into the cross flow manifold 110, and out the side outlet 114. In addition, electrolyte may travel through one or more inlets (not shown) to the ionically resistive element manifold 111, into the ionically resistive element manifold 111, through the openings in the ionically resistive element 107, into the cross flow manifold 110, and out the side outlet 114. After passing through the side outlet 114, the electrolyte spills over weir wall 109. The electrolyte may be recovered and recycled. The electrolyte flowing through the ionically resistive element manifold 111, the ionically resistive element 107, the side inlet 113, the cross flow manifold 110, and the side outlet 114 may be referred to as catholyte. In addition to the catholyte flow, a separate anolyte flow is typically provided. The electrolyte that circulates in contact with the anode may be referred to as anolyte. Often, the catholyte and anolyte have different compositions. The membrane 105 operates to separate the catholyte and anolyte from one another, ensuring that their respective compositions are maintained, while allowing ionic transport through the mechanism during electroplating. The anode chamber 112 includes an inlet (not shown) for receiving anolyte and an outlet (not shown) for removing the anolyte from the anode chamber 112. The inlet and outlet to the anode chamber 112 may be connected with an anolyte recirculation system.

In certain embodiments, the ionically resistive element 107 approximates a nearly constant and uniform current source in the proximity of the substrate (cathode) and, as such, may be referred to as a high resistance virtual anode (HRVA) or channeled ionically resistive element (CIRP) in some contexts. Normally, the ionically resistive element 107 is placed in close proximity with respect to the wafer. In contrast, an anode in the same close-proximity to the substrate would be significantly less apt to supply a nearly constant current to the wafer, but would merely support a constant potential plane at the anode metal surface, thereby allowing the current to be greatest where the net resistance from the anode plane to the terminus (e.g., to peripheral contact points on the wafer) is smaller. So while the ionically resistive element 107 has been referred to as a high-resistance virtual anode (HRVA), this does not imply that electrochemically the two are interchangeable. Under certain operational conditions, the ionically resistive element 107 would more closely approximate and perhaps be better described as a virtual uniform current source, with nearly constant current being sourced from across the upper plane of the ionically resistive element 107.

The ionically resistive element 107 contains micro size (typically less than 0.04") through-holes that are spatially and ionically isolated from each other and do not form interconnecting channels within the body of ionically resistive element, in many but not all implementations. Such through-holes are often referred to as non-communicating through-holes. They typically extend in one dimension, often, but not necessarily, normal to the plated surface of the wafer (in some embodiments the non-communicating holes are at an angle with respect to the wafer which is generally parallel to the ionically resistive element front surface). Often the through-holes are parallel to one another. Often the holes are arranged in a square array. Other times the layout is in an offset spiral pattern. These through-holes are distinct from 3-D porous networks, where the channels extend in three dimensions and form interconnecting pore structures, because the through-holes restructure both ionic current flow and (in certain cases) fluid flow parallel to the surface therein, and straighten the path of both current and fluid flow towards the wafer surface. However, in certain embodiments, such a porous plate, having an interconnected network of pores, may be used as the ionically resistive element. When the distance from the plate's top surface to the wafer is small (e.g., a gap of about 1/10 the size of the wafer radius, for example less than about 5 mm), divergence of both current flow and fluid flow is locally restricted, imparted and aligned with the ionically resistive element channels.

One example ionically resistive element 107 is a disc made of a solid, non-porous dielectric material that is ionically and electrically resistive. The material is also chemically stable in the plating solution of use. In certain cases the ionically resistive element 107 is made of a ceramic material (e.g., aluminum oxide, stannic oxide, titanium oxide, or mixtures of metal oxides) or a plastic material (e.g., polyethylene, polypropylene, polyvinylidene difluoride (PVDF), polytetrafluoroethylene, polysulphone, polyvinyl chloride (PVC), polycarbonate, and the like), having between about 6,000-12,000 non-communicating through-holes. The ionically resistive element 107, in many embodiments, is substantially coextensive with the wafer (e.g., the ionically resistive element 107 has a diameter of about 300 mm when used with a 300 mm wafer) and resides in close proximity to the wafer, e.g., just below the wafer in a wafer-facing-down electroplating apparatus. Preferably, the plated surface of the wafer resides within about 10 mm, more preferably within about 5 mm of the closest ionically resistive element surface. To this end, the top surface of the ionically resistive element 107 may be flat or substantially flat. Often, both the top and bottom surfaces of the ionically resistive element 107 are flat or substantially flat. In a number of embodiments, however, the top surface of the ionically resistive element 107 includes a series of linear ribs, as described further below.

As above, the overall ionic and flow resistance of the plate 107 is dependent on the thickness of the plate and both the overall porosity (fraction of area available for flow through the plate) and the size/diameter of the holes. Plates of lower porosities will have higher impinging flow velocities and ionic resistances. Comparing plates of the same porosity, one having smaller diameter 1-D holes (and therefore a larger number of 1-D holes) will have a more micro-uniform distribution of current on the wafer because there are more individual current sources, which act more as point sources that can spread over the same gap, and will also have a higher total pressure drop (high viscous flow resistance).

In some cases, about 1-10% of the ionically resistive element 107 is open area through which ionic current can pass (and through which electrolyte can pass if there is no other element blocking the openings). In particular embodiments, about 2-5% the ionically resistive element 107 is open area. In a specific example, the open area of the ionically resistive element 107 is about 3.2% and the effective total open cross sectional area is about 23 $cm^2$. In some embodiments, non-communicating holes formed in the ionically resistive element 107 have a diameter of about 0.01 to 0.08 inches. In some cases, the holes have a diameter of about 0.02 to 0.03 inches, or between about 0.03-0.06 inches. In various embodiments the holes have a diameter that is at most about 0.2 times the gap distance between the ionically resistive element 107 and the wafer. The holes are generally circular in cross section, but need not be. Further, to ease construction, all holes in the ionically resistive element 107 may have the same diameter. However this need not be the case, and both the individual size and local density of holes may vary over the ionically resistive element surface as specific requirements may dictate.

The ionically resistive element 107 shown in FIGS. 1A and 1B includes a series of linear ribs 115 that extend into/out of the page. The ribs 115 are sometimes referred to as protuberances. The ribs 115 are positioned on the top surface of the ionically resistive element 107, and they are oriented such that their length (e.g., their longest dimension) is perpendicular to the direction of cross flowing electrolyte. The ribs 115 affect the fluid flow and current distribution within the cross flow manifold 110. For instance, the cross flow of electrolyte is largely confined to the area above the top surface of the ribs 115, creating a high rate of electrolyte cross flow. In the regions between adjacent ribs 115, current delivered upward through the ionically resistive element 107 is redistributed, becoming more uniform, before it is delivered to the substrate surface.

In FIGS. 1A and 1B, the direction of cross flowing electrolyte is left-to-right (e.g., from the side inlet 113 to the side outlet 114), and the ribs 115 are oriented such that their lengths extend into/out of the page. In certain embodiments, the ribs 115 may have a width (measured left-to-right in FIG. 1A) between about 0.5 mm-1.5 mm, in some cases between about 0.25 mm-10 mm. The ribs 115 may have a height (measured up-down in FIG. 1A) between about 1.5 mm-3.0 mm, in some cases between about 0.25 mm-7.0 mm. The ribs 115 may have a height to width aspect ratio (height/width) between about 5/1-2/1, in some cases between about 7/1-1/7. The ribs 115 may have a pitch between about 10 mm-30 mm, in some cases between about 5 mm-150 mm. The ribs 115 may have variable lengths (measured into/out of the page in FIG. 1A) that extend across the face of the ionically resistive element 107. The distance between the upper surface of the ribs 115 and the surface of the substrate 102 may be between about 1 mm-4 mm, or between about 0.5 mm-15 mm. The ribs 115 may be provided over an area that is about coextensive with the substrate, as shown in FIGS. 1A and 1B. The channels/openings in the ionically resistive element 107 may be positioned between adjacent ribs 115, or they may extend through the ribs 115 (in other words, the ribs 115 may or may not be channeled). In some other embodiments, the ionically resistive element 107 may have an upper surface that is flat (e.g., does not include the ribs 115). In some other embodiments, the ribs 115 may be replaced with a raised plateau region. The electroplating apparatus shown in FIGS. 1A and 1B, including the ionically resistive element with ribs thereon, is further discussed in U.S. Pat. No. 9,523,155, titled "ENHANCEMENT OF ELECTROLYTE HYDRODYNAMICS FOR EFFICIENT MASS TRANSFER DURING ELECTROPLATING," which is herein incorporated by reference in its entirety.

The apparatus may include various additional elements as needed for a particular application. In some cases, an edge flow element may be provided proximate the periphery of the substrate, within the cross flow manifold. The edge flow element may be shaped and positioned to promote a high degree of electrolyte flow (e.g., cross flow) near the edges of the substrate. The edge flow element may be ring-shaped or arc-shaped in certain embodiments, and may be azimuthally uniform or non-uniform. Edge flow elements are further discussed in U.S. patent application Ser. No. 14/924,124, filed Oct. 27, 2015, and titled "EDGE FLOW ELEMENT FOR ELECTROPLATING APPARATUS," which is herein incorporated by reference in its entirety.

In various cases, the apparatus includes sealing member 116 for temporarily sealing the cross flow manifold, as mentioned above. The sealing member may be ring-shaped or arc-shaped, and may be positioned proximate the edges of the cross flow manifold. During electroplating, the sealing member may be repeatedly engaged and disengaged to seal and unseal the cross flow manifold. In other cases, the sealing member may remain engaged during electroplating. The sealing member may be engaged and disengaged by moving the substrate support, ionically resistive element, front side insert, or other portion of the apparatus that engages with the sealing member. Sealing members and methods of modulating cross flow are further discussed in the following U.S. Patent Applications, each of which is herein incorporated by reference in its entirety: U.S. patent application Ser. No. 15/225,716, filed Aug. 1, 2016, and titled "DYNAMIC MODULATION OF CROSS FLOW MANIFOLD DURING ELECTROPLATING"; and U.S. patent application Ser. No. 15/161,081, filed May 20, 2016, and titled "DYNAMIC MODULATION OF CROSS FLOW MANIFOLD DURING ELECTROPLATING."

In various embodiments, one or more electrolyte jet may be provided to deliver additional electrolyte above the ionically resistive element. The electrolyte jet may deliver electrolyte proximate a periphery of the substrate, or at a location that is closer to the center of the substrate, or both. The electrolyte jet may be oriented in any position, and may deliver cross flowing electrolyte, impinging electrolyte, or a combination thereof. Electrolyte jets are further described in U.S. patent application Ser. No. 15/455,011, filed Mar. 9, 2017, and titled "ELECTROPLATING APPARATUS AND METHODS UTILIZING INDEPENDENT CONTROL OF IMPINGING ELECTROLYTE," which is herein incorporated by reference in its entirety.

In some cases, an additional membrane may be provided proximate the ionically resistive element. The additional membrane may be below, above, or within the ionically resistive element. The additional membrane may operate to prevent or minimize electrolyte flowing downward from the cross flow manifold 110 into the ionically resistive element manifold 111. Such flow sometimes occurs as a result of high flow and high pressure in the cross flow manifold 110 relative to regions below the ionically resistive element 107. When this issue occurs, the electrolyte typically travels downward through the ionically resistive element 107 in a region proximate the side inlet 113, then travels back upward through the ionically resistive element 107 at a high flow rate proximate the side outlet 114. In these or other cases, one or more baffles may be provided in the ionically resistive element manifold 111. Similar to the additional membrane, these baffles may operate to reduce unwanted flow from the cross flow manifold 110, through the ionically resistive element 107 proximate the side inlet 113, laterally across the ionically resistive element manifold 111, then back up through the ionically resistive element 107 proximate the side outlet 114. The baffles may have any shape, but in some cases are linearly oriented, parallel with the protuberances and perpendicular to the direction of cross flowing electrolyte. The baffles may occupy the entire height of the ionically resistive element manifold 11, or a portion thereof. Such additional membranes and baffles are further discussed in U.S. Provisional Application No. 62/548,116, filed Aug. 21, 2017, and titled "METHODS AND APPARATUS FOR FLOW ISOLATION AND FOCUSING DURING ELECTROPLATING," which is herein incorporated by reference in its entirety.

The pressure in the various regions of the electroplating apparatus is affected by a number of factors including the rate of electrolyte flow through each region. In many conventional applications, the pressure within the ionically resistive element manifold 111 is slightly less than the pressure within the anode chamber 112 during electroplating. However, recent advances have led to the use of a relatively high rate of electrolyte flow through the side inlet 113 and across the cross flow manifold 110. Further, recent advances have led to the use of a sealed cross flow manifold 110 during electroplating. This sealing and high rate of electrolyte flow in the cross flow manifold 110 during plating provides a relatively high pressure within the cross flow manifold 110. This high pressure can cause some of the electrolyte to travel down from the cross flow manifold 110 into the ionically resistive element manifold 111, as described above. The high pressure within the cross flow manifold 110 is thus transferred through the ionically resistive element 107 to result in a relatively high pressure within the ionically resistive element manifold 111. As a result, the pressure within the ionically resistive element manifold 111 can be greater than the pressure within the anode chamber 112 during electroplating.

FIG. 1B illustrates one problem that can occur when the pressure within the ionically resistive element manifold 111 is greater than the pressure within the anode chamber 112. When this occurs, the membrane 105 can be forced away from the membrane frame 106. The membrane 105 stretches downwards, thereby effectively increasing the volume of the ionically resistive element manifold 111 and decreasing the volume of the anode chamber 112. This can cause a number of plating problems. For example, stretching the membrane 105 can cause small tears in the membrane, particularly within a layer that provides cationic transfer and/or electro-osmotic drag properties. This degrades the functionality of the membrane and shortens its lifespan.

Figure 7:
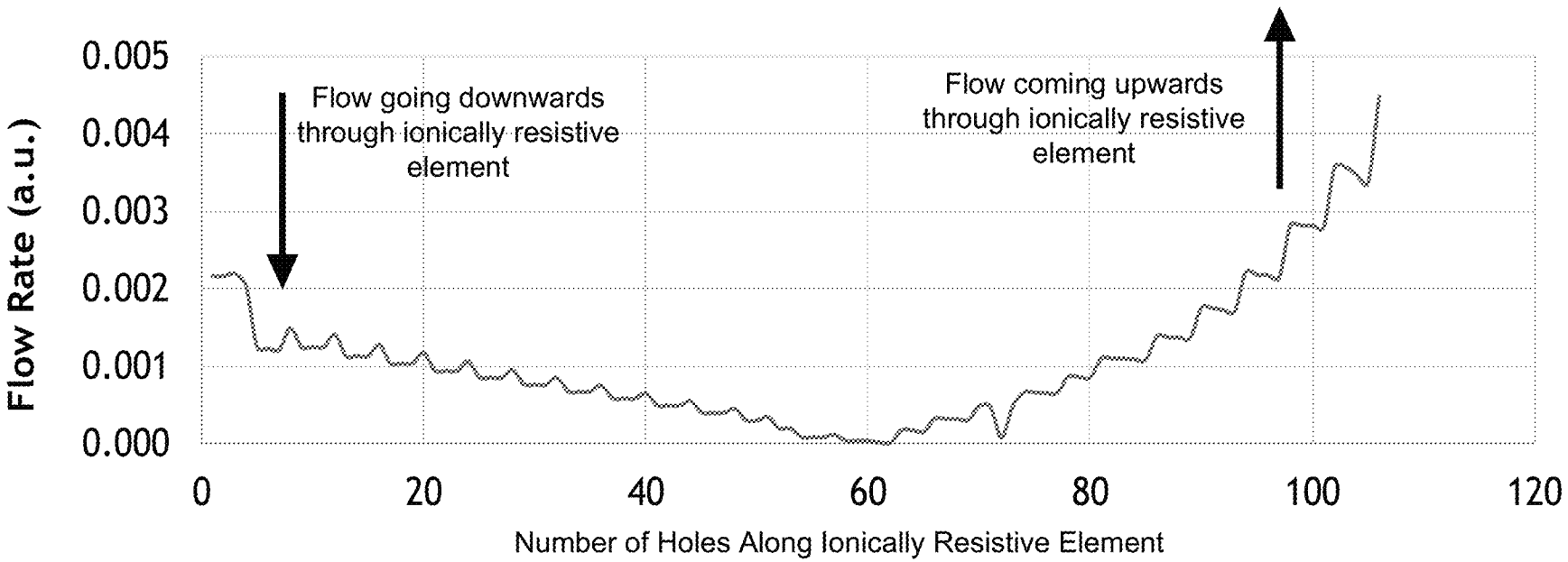
FIG. 7 presents modeling results describing the flow rate through particular holes in an ionically resistive element.
Figure 8B:
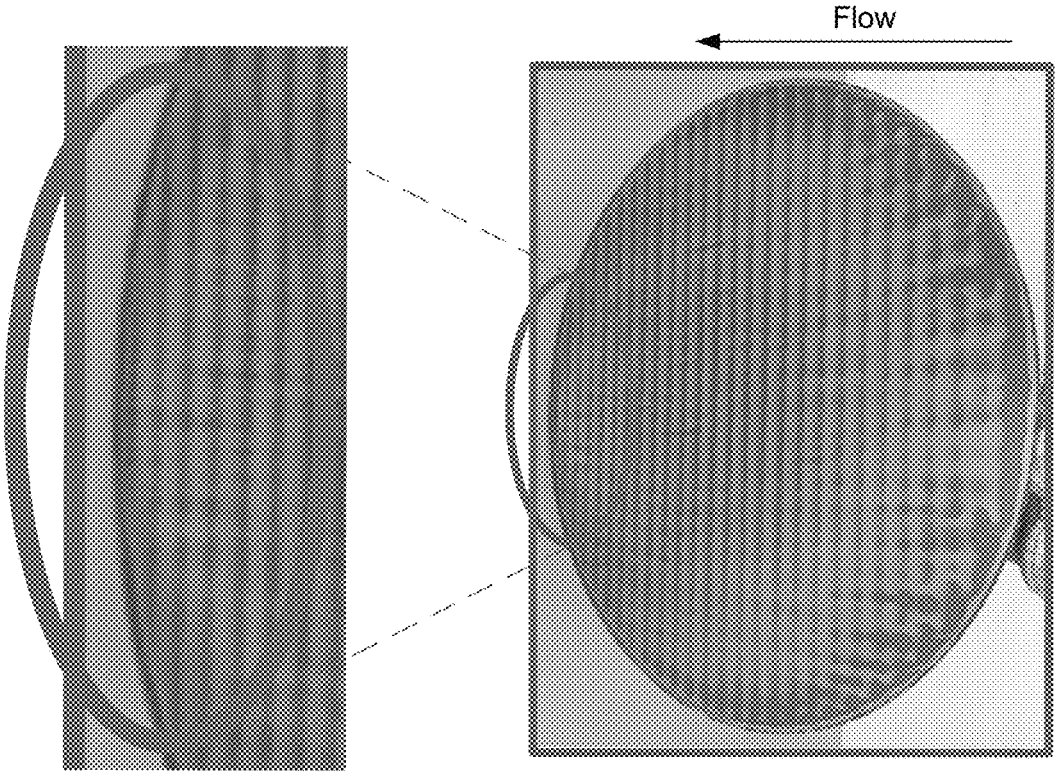
FIGS. 8A and 8B depict experimental results illustrating problematic electrolyte flow issues in a case where the pressure in the anode chamber is constant (FIG. 8A), and the improvement in such results where the pressure in the anode chamber is dynamically controlled as described herein (FIG. 8B).
Figure 8A:
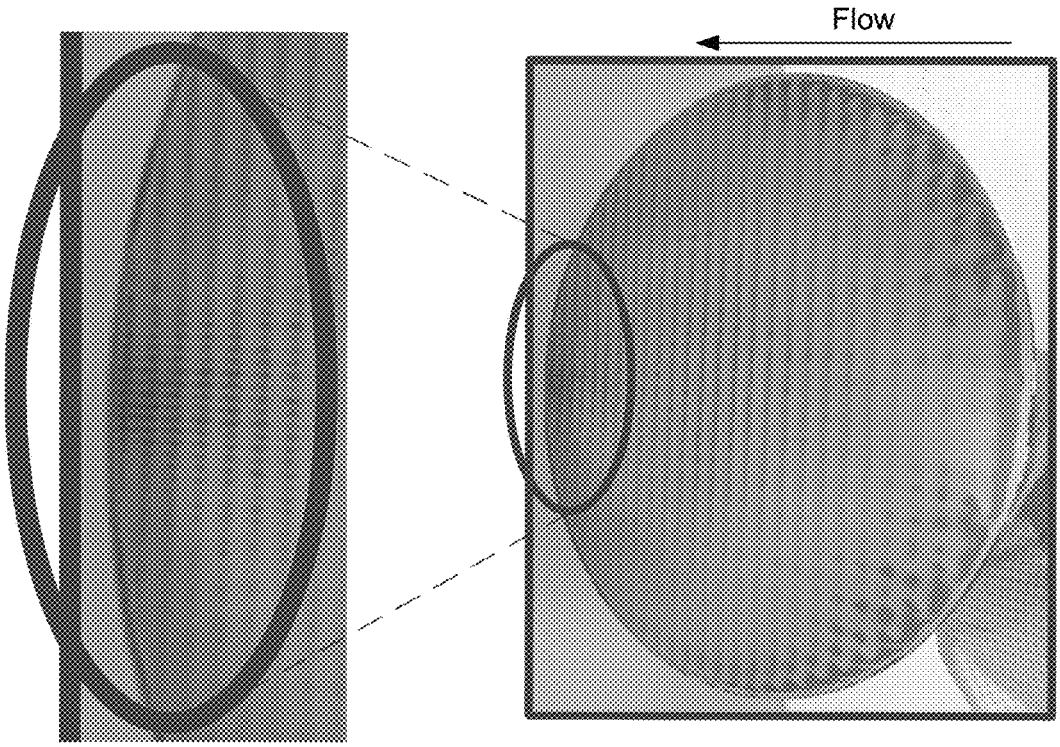

Second, the stretched membrane can form pockets that trap air bubbles, which can adversely affect electrodeposition uniformity on the substrate. Third, the stretched membrane can cause electrolyte to be routed through the apparatus in a non-desirable manner during electroplating, thereby resulting in poor plating results. This may be particularly problematic in cases where baffles (not shown) are provided in the ionically resistive element manifold 111, as described above. The baffles prevent or reduce lateral flow of electrolyte (e.g., from left-to-right in FIG. 1B) across the ionically resistive element manifold 111. However, in cases where the membrane 105 is stretched downwards as shown in FIG. 1B, the electrolyte is able to travel laterally across the apparatus in the region below the membrane frame 106 and above the stretched membrane 105, since the baffles typically do not extend below the membrane frame 106. In other words, when the membrane 105 is stretched away from the membrane frame 106, it provides a route through which a portion of the electrolyte can "short circuit" by traveling laterally across the apparatus in the region between the membrane frame 106 and the membrane 105, rather than traveling across the cross flow manifold 110, as desired. This non-desired flow pattern is illustrated in FIG. 1B. Even in cases where the baffles are omitted, as shown in FIG. 1B, stretching of membrane 105 may exacerbate issues related to lateral flow across the ionically resistive element manifold 111. Modeling results illustrating flow through the ionically resistive element 107 at different locations on the ionically resistive element are shown in FIG. 7. As discussed further below, the results indicate that near the side inlet 113, electrolyte travels downward from the cross flow manifold 110, through the channels in the ionically resistive element 107, and into the ionically resistive element manifold 111, while near the side outlet 114, electrolyte travels upward from the ionically resistive element manifold 111, through the channels in the ionically resistive element 107, and back into the cross flow manifold 110. Experimental results illustrating the effects of this undesirable flow pattern are shown in FIG. 8A. By contrast, FIG. 8B shows experimental results related to embodiments herein where the pressure in the anode chamber 112 is actively controlled to be greater than the pressure in the ionically resistive element manifold 111. FIGS. 7, 8A and 8B are discussed further below in the section related to Experimental and Modeling Results.

Fourth, the changing volumes of the ionically resistive element manifold 111 and anode chamber 112 can be problematic, particularly when loading and unloading substrates. In various recent applications, when the substrate support 103 is in a plating position, as shown in FIG. 1B, and electrolyte is being routed through the apparatus for plating purposes, the pressure in the ionically resistive element manifold 111 may be about 1.0 PSI (e.g., about 6,900 Pascal), while the pressure in the anode chamber 112 may be about 0.5 PSI (e.g., about 3,450 Pascal). By contrast, when the substrate support 103 is raised to a non-plating position (e.g., such that a substrate can be loaded or unloaded), the pressure within the ionically resistive element manifold 111 may drop to approximately 0.15 PSI (e.g., about 1,035 Pascal), while the pressure within the anode chamber 112 remains unchanged at about 0.5 PSI (e.g., about 3,450 Pascal). This means that when the substrate support 103 is in the plating position and electrolyte is being routed for electroplating, the pressure in the ionically resistive element manifold 111 is substantially higher than (e.g., about two times) the pressure in the anode chamber 112. This causes the membrane 105 to stretch away from the membrane frame 105, thus causing the volume of the ionically resistive element manifold 111 to increase while simultaneously decreasing the volume of the anode chamber 112. When the substrate support 103 is raised to the non-plating position, the relative pressures are reversed and the pressure in the anode chamber 112 is higher than the pressure in the ionically resistive element manifold 111. This causes the membrane 105 to return to the membrane frame 106, thereby decreasing the volume of the ionically resistive element manifold 111 and decreasing the volume of the anode chamber 112. These volume changes are problematic because they can trigger unnecessary dosing of the anolyte with deionized water and virgin makeup solution (VMS). In many cases, the volume changes may be detected by a system that is used to monitor the pressure and/or volume of the anolyte/anode chamber. The dosing of deionized water and VMS may be automatic as a result of the detected changes. The unnecessary dosing can dilute the anolyte, which can lead to formation of $CuO_x$ particles, and can eventually lead to passivation of the anode. Further, this dilution can carry over to the catholyte, and may require increased bleed and feed or other electrolyte bath corrections.

Figure 2A:
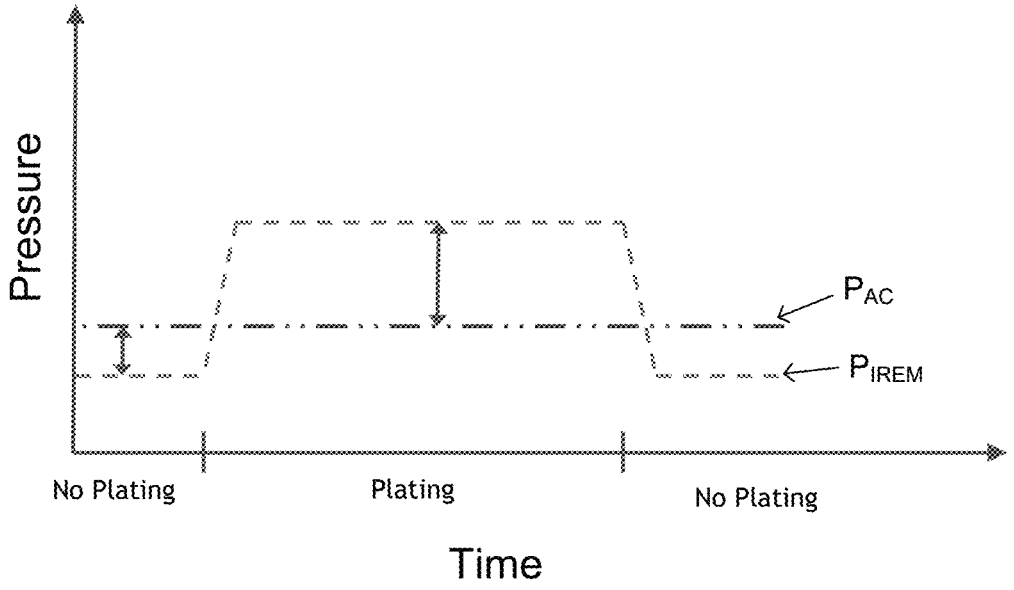
FIGS. 2A and 2B illustrate pressure vs. time profiles according to two different control methods.

In many conventional cases, the anode chamber is configured to remain at a constant pressure, both when plating and when idle. This is not particularly problematic when the electrolyte flow rates are relatively low and/or when the cross flow manifold isn't sealed, such that the pressure within the cross flow manifold is approximately equal to the pressure within the anode chamber, and such that the pressure within the cross flow manifold doesn't change substantially between plating and non-plating operations. However, with newer designs that result in relatively higher pressures within the cross flow manifold (compared to those used previously), this constant anode chamber pressure can contribute to the problems described above with respect to membrane 105 of FIG. 1B. For example, FIG. 2A illustrates the pressure in the anode chamber ($P_{AC}$) and in the ionically resistive element manifold ($P_{IREM}$) as the apparatus cycles between non-plating operations (e.g., unloading and loading substrates onto the substrate support) and plating operations where the anode chamber pressure is constant. Where this is the case, $P_{AC}$ is greater than $P_{IREM}$ during non-plating times, and $P_{AC}$ is less than $P_{IREM}$ during plating times. When $P_{AC}$ is greater than $P_{IREM}$, the issues discussed above can have substantial deleterious effects on the plating results.

Figure 2B:
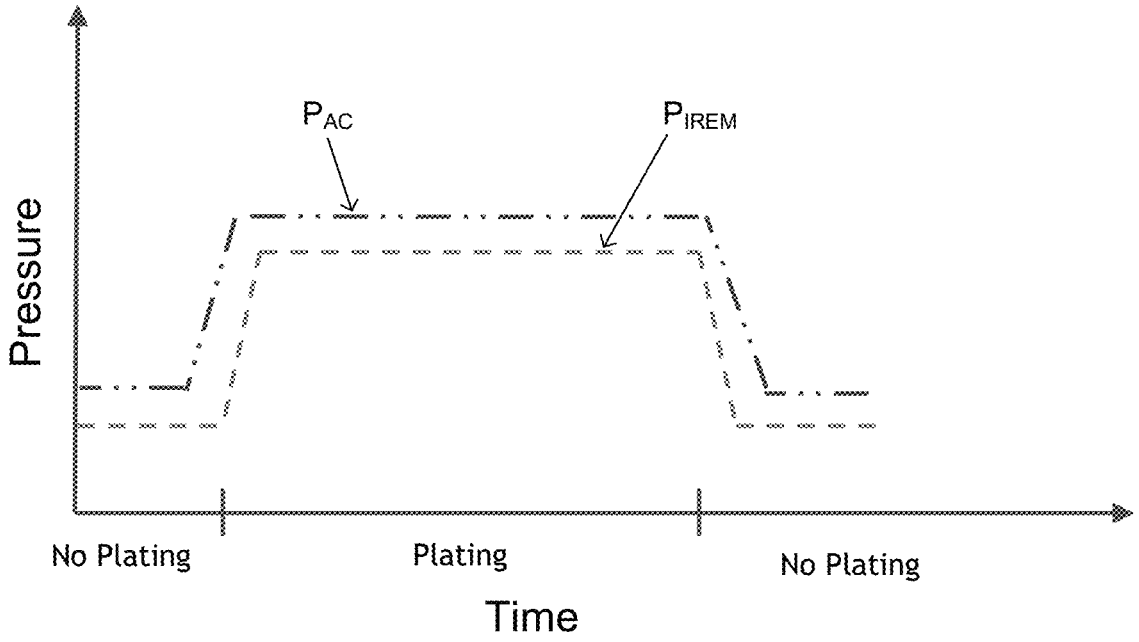

In various embodiments herein, the pressure within the anode chamber is dynamically controlled to ensure that it is always slightly higher than the pressure within the ionically resistive element manifold, as shown in FIG. 2B. The pressure within the anode chamber is controlled to be non-constant, with a higher pressure being provided when the apparatus is used to electroplate, and a lower pressure being provided when the apparatus is not being used to electroplate. Because the pressure in the anode chamber is actively controlled to be greater than the pressure in the ionically resistive element manifold, the problems described above related to membrane stretching are prevented from occurring.

A number of different techniques may be used to ensure that the pressure in the anode chamber remains slightly above the pressure in the ionically resistive element manifold. These techniques may be used separately or in combination with one another. In one example shown in FIG. 3A, the pressure in the anode chamber 312 is controlled primarily by controlling the flow rate through the pump 321 that feeds the anode chamber 312. The flow rate through the pump 321 is controlled by a control system 320, which controls the flow rate through the pump 321 based on a position of the substrate support 303 in the electroplating chamber. Thus, the position of the substrate support 303 is fed to the control system, which controls the flow rate through pump 321, which affects the pressure in the anode chamber 312. The pressure in the anode chamber 312 is therefore controlled based on the position of the substrate support 303.

Figure 3A:
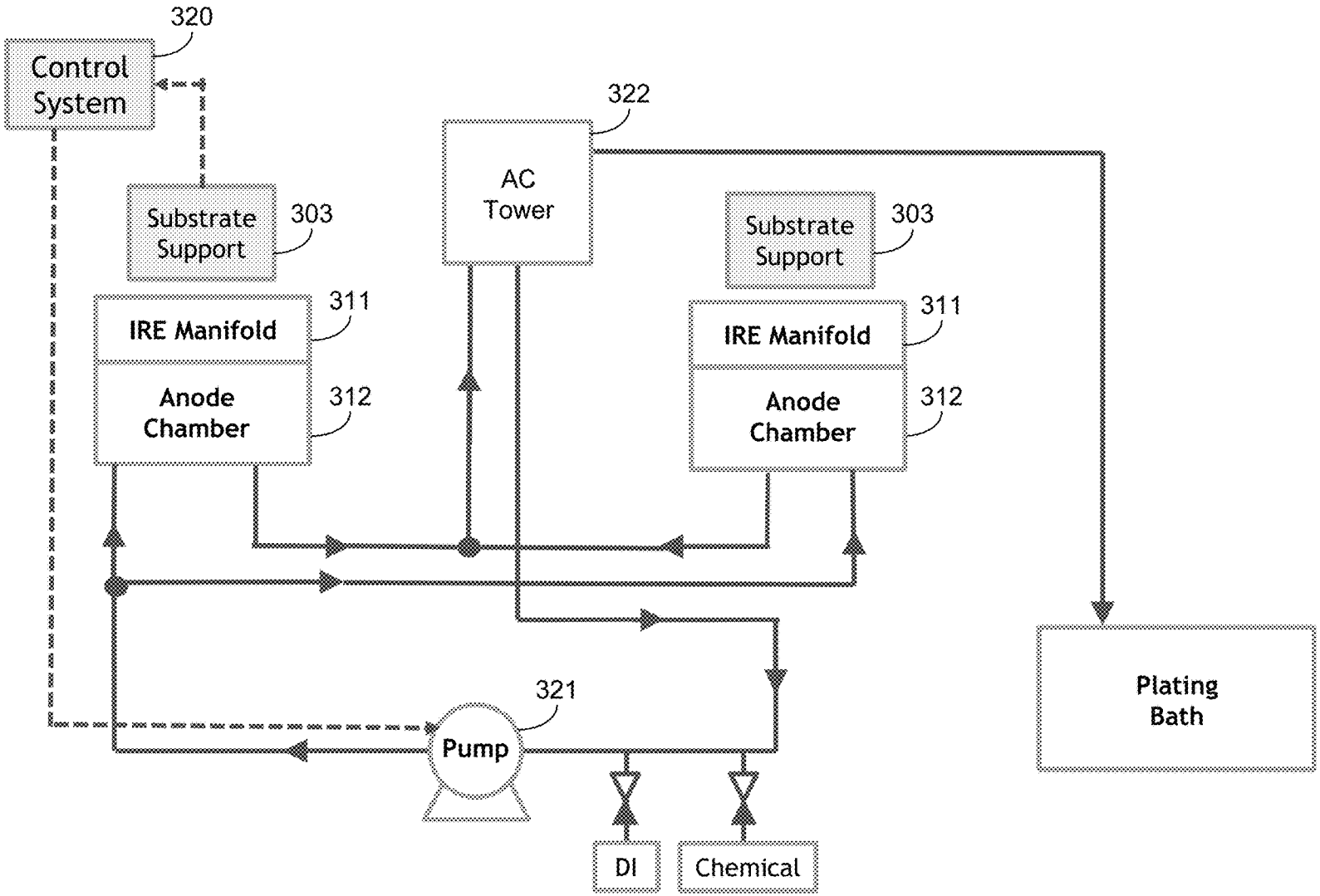
FIG. 3A depicts a schematic representation of an electroplating system according to one embodiment where the pressure in an anode chamber is controlled by controlling the flow through a pump, which is controlled based on a position of a substrate holder.

In FIG. 3A, two electroplating chambers are operating in tandem. Each electroplating chamber includes an anode chamber 312, an ionically resistive element manifold 311 (referred to in FIG. 3A as the "IRE Manifold"), and a substrate support 303. The electroplating chambers may be as shown in FIG. 1A, for example. While not depicted in the schematic drawing of FIG. 3A, it is understood that a cross flow manifold forms below the substrate support 303 and above the ionically resistive element/ionically resistive element manifold 311 when the substrate support 303 is lowered into position for plating. Also not depicted in the schematic drawing of FIG. 3A is the recirculation system for recirculating the catholyte.

The two electroplating chambers shown in FIG. 3A are fluidically connected with an anode chamber tower (referred to in FIG. 3A as the "AC Tower"). The anode chamber tower may operate to provide a static pressure head, thereby establishing a relatively constant pressure in the anode chamber 312 during certain desired times, for example during electroplating and/or during idling. In certain cases, the anode chamber tower may be omitted. Even when the anode chamber tower is present, it is still possible to affect the pressure in the anode chamber by controlling the rate at which electrolyte enters and/or leaves the anode chamber.

The anolyte is recirculated as shown in FIG. 3A. Deionized water and chemicals (e.g., virgin makeup solution) can be dosed into the anolyte as needed. In this embodiment, the two electroplating chambers are operated together. Thus, when the substrate support 303 in one of the chambers is lowered to a plating position, the substrate support 303 in the other chamber is lowered at the same time. Any number of electroplating chambers can be operated together in this manner. In some embodiments, only a single electroplating chamber is provided.

Figure 3B:
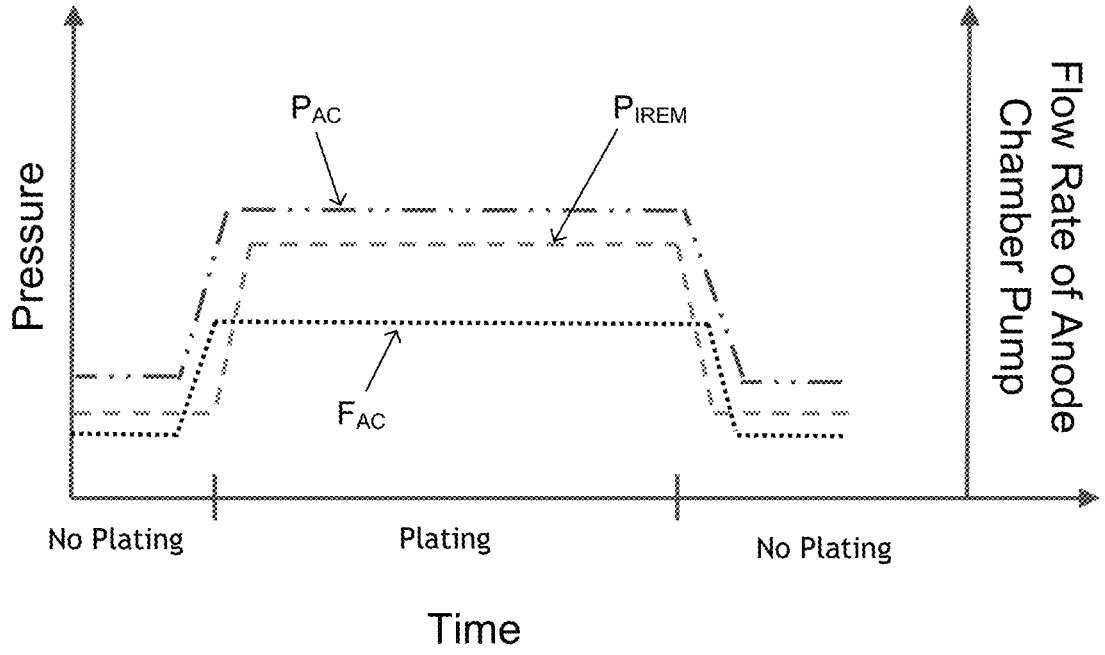
FIG. 3B illustrates a pressure vs. time profile and flow vs. time profile according to certain embodiments.

FIG. 3B illustrates the pressure in the anode chamber ($P_{AC}$), the pressure in the ionically resistive element manifold ($P_{IREM}$), and the flow rate through the pump 321 feeding the anode chamber 312 ($F_{AC}$) according to one embodiment. FIG. 3B is the same as FIG. 2B, with the addition of $F_{AC}$. In this embodiment, the value of $F_{AC}$ is controlled based on the position of the substrate support 303 within the chamber, as explained in relation to FIG. 3A. When no plating is occurring, the substrate support 303 is raised such that a substrate can be loaded/unloaded. When the substrate support 303 is in the raised position, the flow rate through the pump 321 feeding the anode chamber 312 remains relatively low. This establishes a relatively low pressure in the anode chamber 312, which is still slightly higher than the pressure in the ionically resistive element manifold 311. When a substrate is loaded onto the substrate support 303 and the substrate support is lowered into a plating position, the flow rate through the pump 321 feeding the anode chamber 312 increases (based on a position of the substrate support 303), thereby increasing the pressure in the anode chamber 312 such that it remains slightly above the pressure in the ionically resistive element manifold 311 (which itself increases as a result of sealing the cross flow manifold and/or increasing the flow rate through the cross flow manifold during electroplating). When plating is complete and the substrate support 303 returns to its raised position, the flow rate through the pump 321 feeding the anode chamber 312 decreases (based on the position of the substrate support 303), again ensuring that the pressure in the anode chamber 312 remains slightly above the pressure in the ionically resistive element manifold 311. The desired correlation between substrate support position and pump flow rate (feeding the anode chamber) can be determined through experimentation and/or modeling.

Figure 4:
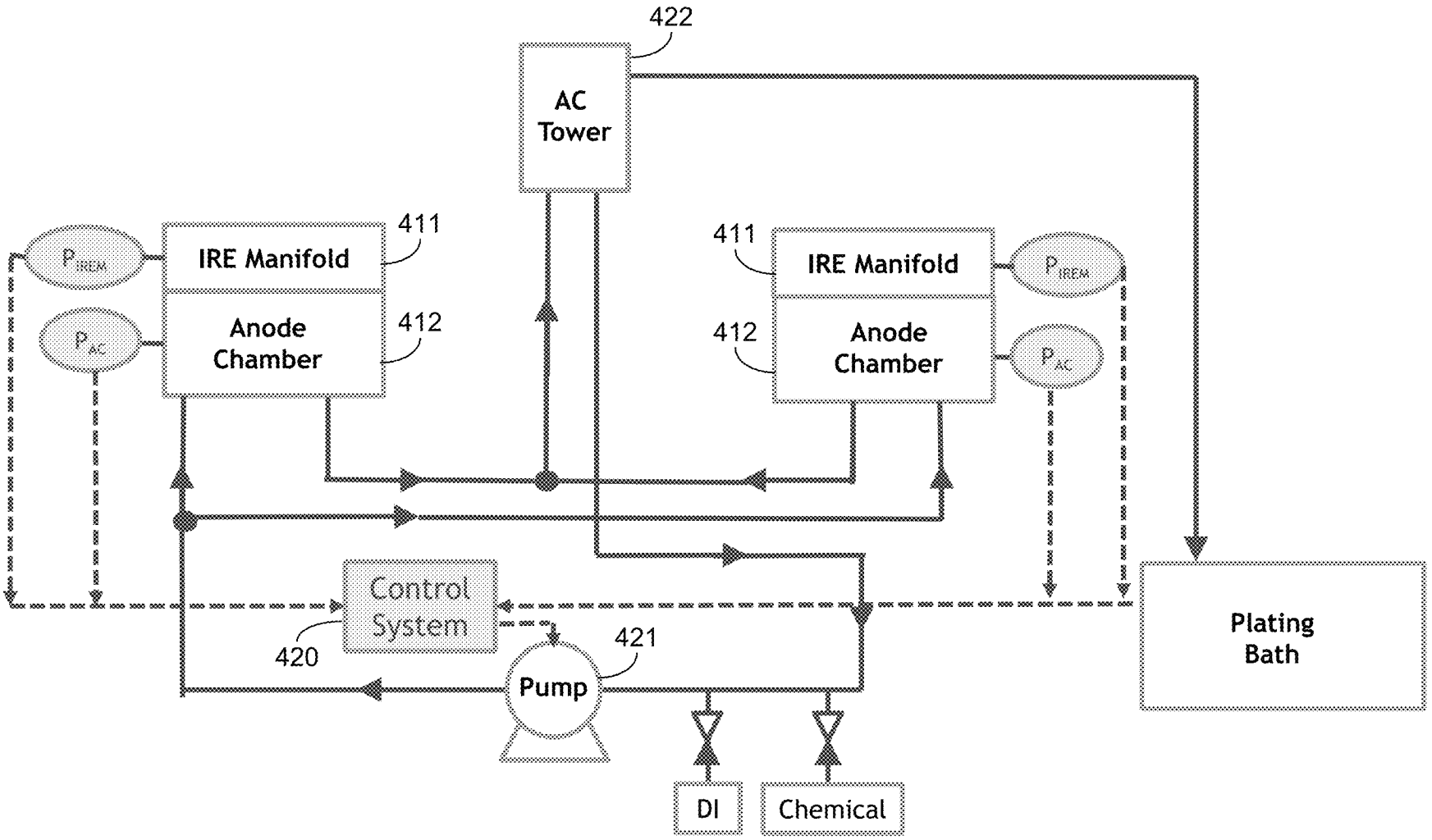
FIG. 4 depicts a schematic representation of an electroplating system according to one embodiment where the pressure in an anode chamber is controlled by controlling the flow through a pump, which is controlled based on a sensed pressure differential between the anode chamber and an ionically resistive element manifold.

FIG. 4 illustrates an embodiment in which the flow rate through the pump 421 feeding the anode chamber 412 is controlled based on the pressures sensed in the ionically resistive element manifold 411 ($P_{IREM}$) and in the anode chamber ($P_{AC}$). Each of $P_{IREM}$ and $P_{AC}$ are measured by pressure sensors, and fed to control system 420. The control system 420 compares $P_{AC}$ and $P_{IREM}$, and controls the flow rate through pump 421 such that $P_{AC}$ remains slightly above $P_{IREM}$. The flow rate through pump 421 directly affects $P_{AC}$, with an increase in flow resulting in increased $P_{AC}$. In this way, $P_{AC}$ and $P_{IREM}$ can be constantly monitored, and $P_{AC}$ can be constantly controlled to be slightly greater than $P_{IREM}$, for example during both plating and non-plating operations. The pressures and flow rates shown in FIG. 3B may also apply for the embodiment shown in FIG. 4. One advantage of the embodiment of slide 4 is that the pump 421 can be configured to provide a constant rate of electrolyte flow to the anode chamber 412, thereby providing a constant rate of anode irrigation.

In certain embodiments, one or more of the pressure sensors may be a high-accuracy silicon sensor protected by an oil-filled stainless steel diaphragm with pressure range below 100 psi.

Similar to the embodiment shown in FIG. 3A, the embodiment of FIG. 4 illustrates two electroplating chambers operating in tandem. In various embodiments, any number of electroplating chambers may be operated together in this manner. In a particular embodiment, only one electroplating chamber is provided.

Figure 5:
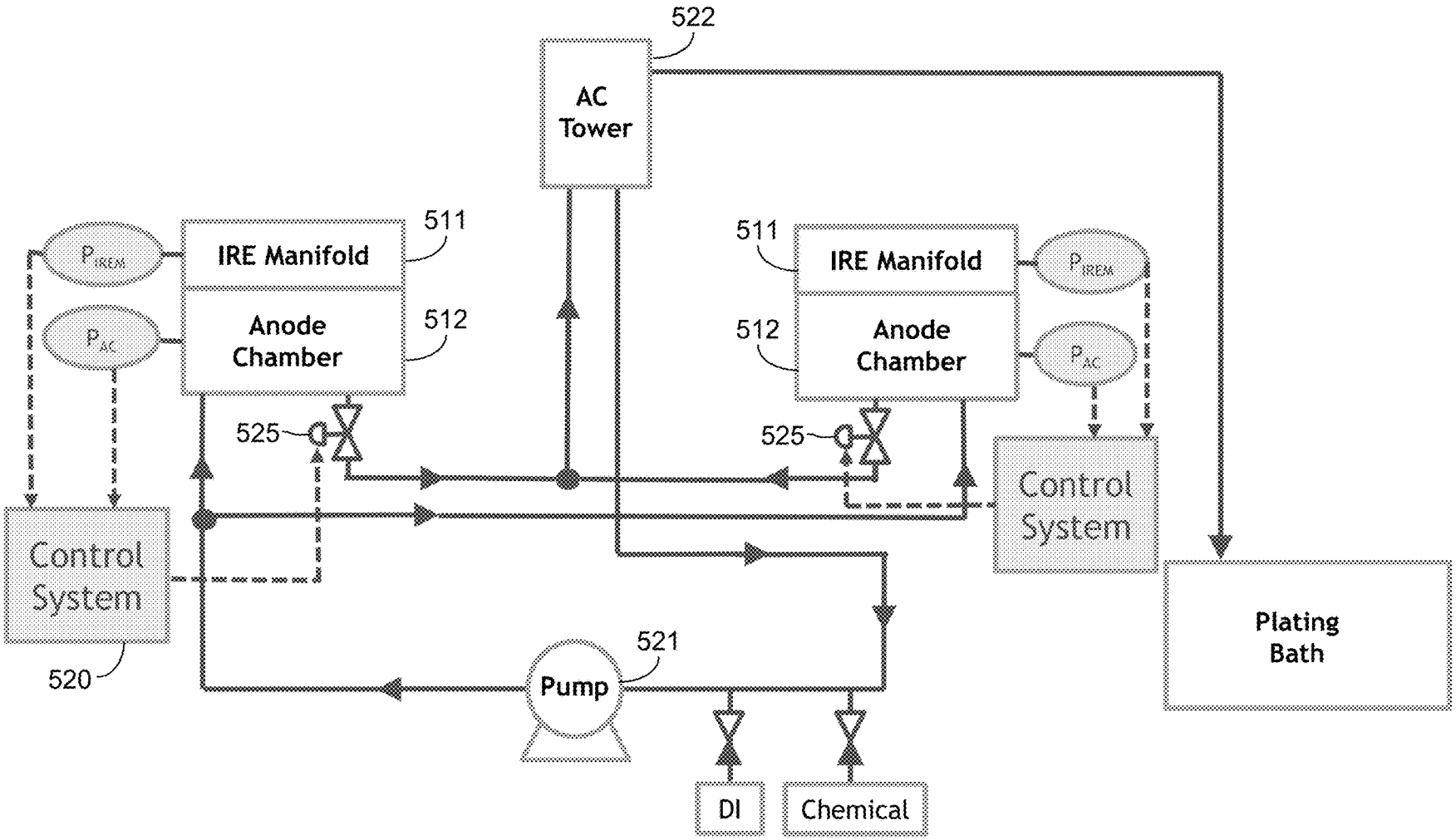
FIG. 5 depicts a schematic representation of an electroplating system according to one embodiment where the pressure in an anode chamber is controlled by controlling the degree to which the flow out of the anode chamber is restricted, which is controlled based on a sensed pressure differential between the anode chamber and an ionically resistive element manifold.

FIG. 5 illustrates an embodiment in which the pressure in the anode chamber 512 is controlled to always be slightly higher than the pressure in the ionically resistive element manifold 511 by controlling the position of a valve 525 for electrolyte leaving the anode chamber 512. All else being equal, when valve 525 is relatively more closed, the pressure within the anode chamber 512 is higher, and when valve 525 is relatively more open, the pressure within the anode chamber 512 is lower. The embodiment of FIG. 5 is similar to the embodiment of FIG. 4 in that the pressure within the ionically resistive element manifold 511 ($P_{IREM}$) and the pressure within the anode chamber 512 ($P_{AC}$) are actively monitored by pressure sensors, which feed the measured pressures to a control system 520. However, the embodiment of FIG. 5 actively controls the pressure in the anode chamber 512 by controlling the outlet restriction size for anolyte leaving the anode chamber 512 (e.g., by controlling the position of valve 525), while the embodiment of FIG. 4 actively controls the pressure in the anode chamber 412 by controlling the flow rate of anolyte entering the anode chamber 412 (e.g., by controlling the flow rate through pump 421). Either or both of these approaches may be used to ensure that that $P_{AC}$ remains slightly higher than $P_{IREM}$ at all times.

As with the embodiments of FIGS. 3A and 4, the embodiment of FIG. 5 illustrates two electroplating chambers operating in tandem. Any number of electroplating chambers may be operated together in this manner, and in a particular embodiment only a single electroplating chamber is provided.

One advantage to the embodiments of FIGS. 4 and 5 is that they provide redundant pressure monitoring between the different plating chambers. For example, because the two chambers are operated in tandem, the pressures within each plating chamber should track one another. In other words, the measured $P_{IREM}$ from one chamber should match the $P_{IREM}$ from the other chamber, and the measured $P_{AC}$ from one chamber should match the $P_{AC}$ from the other chamber. If a discrepancy occurs between the two $P_{IREM}$ readings, or between the two $P_{AC}$ readings, this may indicate a problem with the integrity of one of the membranes separating the ionically resistive element manifold from the anode chamber, or with the integrity of a seal around the periphery of one of the substrate supports (e.g., the seal that seals the cross flow manifold).

Another advantage of the embodiments described herein is the substantial improvement in the reliability and lifetime of the cationic membrane separating the anode chamber from the ionically resistive element manifold. Further, the embodiments herein provide improved plating performance as a result of avoiding unnecessary anolyte dosing, thereby establishing more stable anolyte and catholyte compositions. Additionally, the embodiments herein provide improved plating performance as a result of improved electrolyte flow through the apparatus.

Various other techniques are available for ensuring that the pressure in the anode chamber remains higher than the pressure in the ionically resistive element manifold. For instance, the flow rate through the pump feeding the anode chamber can be raised such that the pressure in the anode chamber remains at a static/uniform value that is higher than the pressure experienced in the ionically resistive element manifold during electroplating. Alternatively or in addition, the flow leaving the anode chamber can be restricted such that the pressure in the anode chamber remains at a static/uniform value that is higher than the pressure experienced in the ionically resistive element manifold during electroplating. However, these approaches could present other problems, particularly during non-plating times when the pressure in the anode chamber would be significantly higher than the pressure in the ionically resistive element manifold. At such times, the membrane separating the anode chamber from the ionically resistive element manifold would be aggressively pushed against the membrane frame that supports it due to the significant pressure differential between these two regions. This can cause the membrane to stretch and bow into the openings of the membrane frame, and can damage the membrane. Further, such approaches may cause leakage of anolyte from the anode chamber into the catholyte recirculation stream. Various embodiments herein avoid these problems by dynamically controlling the pressure in the anode chamber such that it is always slightly higher than the pressure in the ionically resistive element manifold. With this relatively mild pressure differential, the membrane damage and anolyte leakage problems can be avoided.

Another technique that may be used to prevent one or more of the problems described herein is to provide a mechanical support structure under the membrane separating the anode chamber from the ionically resistive element manifold. For example, with respect to FIG. 1A, the membrane frame 106 is provided above the membrane 105. In an alternative embodiment, a second membrane frame (not shown) may be provided below the membrane 105. Similarly, a single membrane frame may support the membrane on both sides. Such support would prevent the membrane 105 from stretching downwards, as shown in FIG. 1B. These embodiments may introduce certain problems related to increased trapping of air bubbles proximate the additional support structure/membrane frame positioned below the membrane.

In various embodiments herein, the pressure in the anode chamber is dynamically controlled such that it remains slightly higher than the pressure in the ionically resistive element manifold. The pressure in the anode chamber may be controlled by controlling a flow rate through a pump that feeds the anode chamber and/or by controlling the outlet pipe restriction/valve position for anolyte leaving the anode chamber. The pressure in the anode chamber may be controlled based on a position of the substrate support and/or based on one or more pressure sensed in the anode chamber and/or in the ionically resistive element manifold.

In many cases, the pressure in the anode chamber ($P_{AC}$) is controlled to be between about 0.2-0.7 PSI (e.g., between 1380-4830 Pascal), or in some cases between about 0.1-2.0 PSI (e.g., between about 690-13800 Pascal). $P_{AC}$ may be between about 0.1-0.2 PSI higher (e.g., between about 690-1380 Pascal higher) than the pressure in the ionically resistive element manifold ($P_{IREM}$) when electrolyte is present in the apparatus, including during plating and non-plating times. In various cases, $P_{AC}$ is at least about 0.1 PSI (e.g., at least about 690 Pascal) higher than $P_{IREM}$ during plating and non-plating times. In these or other cases, $P_{AC}$ may be up to about 1.0 PSI greater than (e.g., up to about 6900 Pascal greater than) $P_{IREM}$. Within these ranges, $P_{AC}$ is considered to be slightly greater than $P_{IREM}$, as discussed herein. In certain embodiments, $P_{AC}$ may be between about 0.2-0.7 PSI (e.g., between about 1380-4830 Pascal) during plating times, and may be between about 0.1-0.3 PSI (e.g., between about 690-2070 Pascal) during non-plating times. In these or other embodiments, $P_{IREM}$ may be between 0.1-0.6 PSI (e.g., between about 690-4140 Pascal) during plating times, and may be between about 0-0.2 PSI (e.g., between about 0-1380 Pascal) during non-plating times. In certain embodiments, the flow through the pump feeding the anode chamber may be between about 1.0-4.0 L/min during plating times (e.g., to establish a relatively higher $P_{AC}$), and may be between 0.3-2.0 L/min during non-plating times (e.g., to establish a relatively lower $P_{AC}$). These values may be particularly relevant to the embodiments of FIGS. 3A and 4, which control $P_{AC}$ by controlling the flow rate through pumps 321/421, respectively. In these or other embodiments, the flow of catholyte through the side inlet may be between about 6-120 LPM during plating times and between about 6-70 LPM during non-plating times.

The flow rates, pressures, and other plating conditions described herein are intended to be non-binding examples. While the plating conditions described herein are appropriate for the electroplating systems that have been tested, other systems having different geometries or configurations may be operated at different conditions while still practicing one or more of the embodiments described herein.

Apparatus

The methods described herein may be performed by any suitable apparatus. A suitable apparatus includes hardware for accomplishing the process operations and a system controller having instructions for controlling process operations in accordance with the present embodiments. For example, in some embodiments, the hardware may include one or more process stations included in a process tool.

Figure 6:
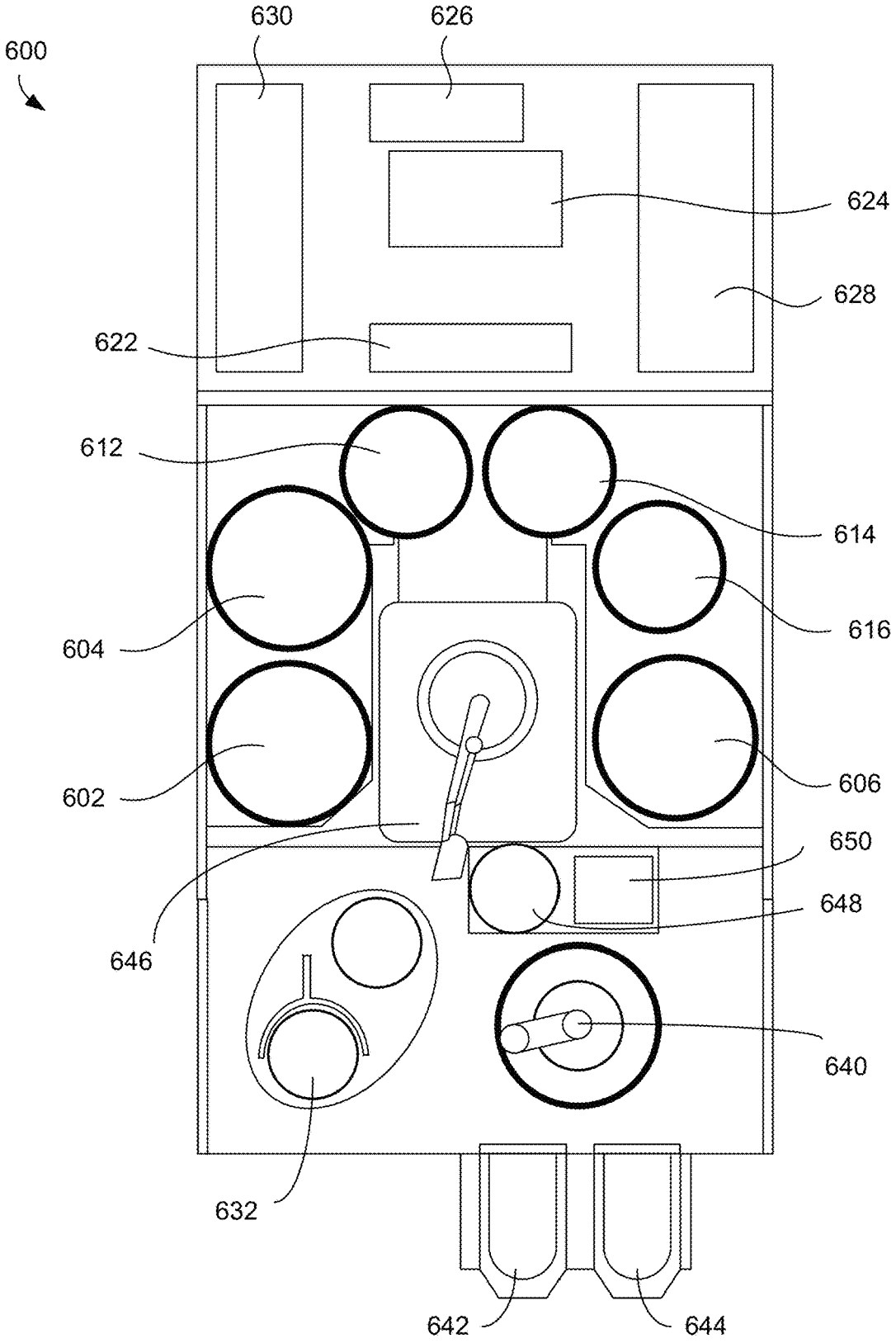
FIG. 6 shows a multi-chamber electroplating apparatus according to certain embodiments.

FIG. 6 shows a schematic of a top view of an example electrodeposition apparatus. The electrodeposition apparatus 600 can include three separate electroplating modules 602, 604, and 606. The electrodeposition apparatus 600 can also include three separate modules 612, 614, and 616 configured for various process operations. For example, in some embodiments, one or more of modules 612, 614, and 616 may be a spin rinse drying (SRD) module. In other embodiments, one or more of the modules 612, 614, and 616 may be post-electrofill modules (PEMs), each configured to perform a function, such as edge bevel removal, backside etching, and acid cleaning of substrates after they have been processed by one of the electroplating modules 602, 604, and 606.

The electrodeposition apparatus 600 includes a central electrodeposition chamber 624. The central electrodeposition chamber 624 is a chamber that holds the chemical solution used as the electroplating solution in the electroplating modules 602, 604, and 606. The electrodeposition apparatus 600 also includes a dosing system 626 that may store and deliver additives for the electroplating solution. A chemical dilution module 622 may store and mix chemicals to be used as an etchant. A filtration and pumping unit 628 may filter the electroplating solution for the central electrodeposition chamber 624 and pump it to the electroplating modules.

A system controller 630 provides electronic and interface controls required to operate the electrodeposition apparatus 600. The system controller 630 (which may include one or more physical or logical controllers) controls some or all of the properties of the electroplating apparatus 600.

Signals for monitoring the process may be provided by analog and/or digital input connections of the system controller 630 from various process tool sensors. The signals for controlling the process may be output on the analog and digital output connections of the process tool. Non-limiting examples of process tool sensors that may be monitored include mass flow controllers, pressure sensors (such as manometers), thermocouples, optical position sensors, etc. Appropriately programmed feedback and control algorithms may be used with data from these sensors to maintain process conditions.

A hand-off tool 640 may select a substrate from a substrate cassette such as the cassette 642 or the cassette 644. The cassettes 642 or 644 may be front opening unified pods (FOUPs). A FOUP is an enclosure designed to hold substrates securely and safely in a controlled environment and to allow the substrates to be removed for processing or measurement by tools equipped with appropriate load ports and robotic handling systems. The hand-off tool 640 may hold the substrate using a vacuum attachment or some other attaching mechanism.

The hand-off tool 640 may interface with a wafer handling station 632, the cassettes 642 or 644, a transfer station 650, or an aligner 648. From the transfer station 650, a hand-off tool 646 may gain access to the substrate. The transfer station 650 may be a slot or a position from and to which hand-off tools 640 and 646 may pass substrates without going through the aligner 648. In some embodiments, however, to ensure that a substrate is properly aligned on the hand-off tool 646 for precision delivery to an electroplating module, the hand-off tool 646 may align the substrate with an aligner 648. The hand-off tool 646 may also deliver a substrate to one of the electroplating modules 602, 604, or 606 or to one of the three separate modules 612, 614, and 616 configured for various process operations.

An example of a process operation according to the methods described above may proceed as follows: (1) electrodeposit copper or another material onto a substrate in the electroplating module 604; (2) rinse and dry the substrate in SRD in module 612; and, (3) perform edge bevel removal in module 614.

An apparatus configured to allow efficient cycling of substrates through sequential plating, rinsing, drying, and PEM process operations may be useful for implementations for use in a manufacturing environment. To accomplish this, the module 612 can be configured as a spin rinse dryer and an edge bevel removal chamber. With such a module 612, the substrate would only need to be transported between the electroplating module 604 and the module 612 for the copper plating and EBR operations. In some embodiments the methods described herein will be implemented in a system which comprises an electroplating apparatus and a stepper.

System Controller

In some implementations, a controller is part of a system, which may be part of the above-described examples. Such systems can comprise semiconductor processing equipment, including a processing tool or tools, chamber or chambers, a platform or platforms for processing, and/or specific processing components (a wafer pedestal, a gas flow system, etc.). These systems may be integrated with electronics for controlling their operation before, during, and after processing of a semiconductor wafer or substrate. The electronics may be referred to as the "controller," which may control various components or subparts of the system or systems. The controller, depending on the processing requirements and/or the type of system, may be programmed to control any of the processes disclosed herein, including the delivery of processing gases, temperature settings (e.g., heating and/or cooling), pressure settings, vacuum settings, power settings, radio frequency (RF) generator settings, RF matching circuit settings, frequency settings, flow rate settings, fluid delivery settings, positional and operation settings, wafer transfers into and out of a tool and other transfer tools and/or load locks connected to or interfaced with a specific system.

Broadly speaking, the controller may be defined as electronics having various integrated circuits, logic, memory, and/or software that receive instructions, issue instructions, control operation, enable cleaning operations, enable endpoint measurements, and the like. The integrated circuits may include chips in the form of firmware that store program instructions, digital signal processors (DSPs), chips defined as application specific integrated circuits (ASICs), and/or one or more microprocessors, or microcontrollers that execute program instructions (e.g., software). Program instructions may be instructions communicated to the controller in the form of various individual settings (or program files), defining operational parameters for carrying out a particular process on or for a semiconductor wafer or to a system. The operational parameters may, in some embodiments, be part of a recipe defined by process engineers to accomplish one or more processing steps during the fabrication of one or more layers, materials, metals, oxides, silicon, silicon dioxide, surfaces, circuits, and/or dies of a wafer.

The controller, in some implementations, may be a part of or coupled to a computer that is integrated with, coupled to the system, otherwise networked to the system, or a combination thereof. For example, the controller may be in the "cloud" or all or a part of a fab host computer system, which can allow for remote access of the wafer processing. The computer may enable remote access to the system to monitor current progress of fabrication operations, examine a history of past fabrication operations, examine trends or performance metrics from a plurality of fabrication operations, to change parameters of current processing, to set processing steps to follow a current processing, or to start a new process. In some examples, a remote computer (e.g. a server) can provide process recipes to a system over a network, which may include a local network or the Internet. The remote computer may include a user interface that enables entry or programming of parameters and/or settings, which are then communicated to the system from the remote computer. In some examples, the controller receives instructions in the form of data, which specify parameters for each of the processing steps to be performed during one or more operations. It should be understood that the parameters may be specific to the type of process to be performed and the type of tool that the controller is configured to interface with or control. Thus as described above, the controller may be distributed, such as by comprising one or more discrete controllers that are networked together and working towards a common purpose, such as the processes and controls described herein. An example of a distributed controller for such purposes would be one or more integrated circuits on a chamber in communication with one or more integrated circuits located remotely (such as at the platform level or as part of a remote computer) that combine to control a process on the chamber.

Without limitation, example systems may include a plasma etch chamber or module, a deposition chamber or module, a spin-rinse chamber or module, a metal plating chamber or module, a clean chamber or module, a bevel edge etch chamber or module, a physical vapor deposition (PVD) chamber or module, a chemical vapor deposition (CVD) chamber or module, an atomic layer deposition (ALD) chamber or module, an atomic layer etch (ALE) chamber or module, an ion implantation chamber or module, a track chamber or module, and any other semiconductor processing systems that may be associated or used in the fabrication and/or manufacturing of semiconductor wafers.

As noted above, depending on the process step or steps to be performed by the tool, the controller might communicate with one or more of other tool circuits or modules, other tool components, cluster tools, other tool interfaces, adjacent tools, neighboring tools, tools located throughout a factory, a main computer, another controller, or tools used in material transport that bring containers of wafers to and from tool locations and/or load ports in a semiconductor manufacturing factory.

Experimental and Modeling Results

FIG. 7 illustrates modeling results related to the electrolyte short circuiting problem described above in relation to certain conventional applications. This problem is exacerbated when the pressure in the ionically resistive element manifold is greater than the pressure in the anode chamber. When this is the case, electrolyte near the side inlet travels down from the cross flow manifold, through the channels in the ionically resistive element, into the ionically resistive element manifold. The electrolyte then travels across the width of the plating chamber (e.g., left to right in FIG. 1A) within the ionically resistive element manifold, then up through the holes in the ionically resistive element, back into the cross flow manifold, near the side outlet. This flow pattern is not desirable, since it reduces the degree of cross flow in the cross flow manifold and can result in higher-than-desired impinging flow on the substrate near the side outlet.

The y-axis in FIG. 7 represents the flow rate of electrolyte through a relevant hole in the ionically resistive element. The x-axis in FIG. 7 represents the number of holes along the ionically resistive element at which the flow is being modeled (e.g., x=0 near the side inlet, and x=60 near the center of the ionically resistive element). The results indicate that some amount of electrolyte is flowing downward through the channels in the ionically resistive element at locations near the side inlet, and that a substantial amount of electrolyte flows upward through the channels of the ionically resistive element at locations near the side outlet. These results are consistent with the electrolyte short circuiting problem described herein.

FIGS. 8A and 8B provide experimental results showing copper seed blanket substrates etched according to two different methods. The substrate in FIG. 8A was etched using a conventional method in which the pressure in the anode chamber was static. By contrast, the substrate in FIG. 8B was etched using a method where the pressure in the anode chamber was dynamically controlled to remain slightly above the pressure in the ionically resistive element manifold. In order to better observe the effects of the electrolyte flow pattern, the substrates were not rotated during etching. In FIGS. 8A and 8B, the direction of cross flowing electrolyte was from bottom-to-top. In other words, the bottom portion of each substrate was positioned proximate the side inlet, and the top portion of each substrate (e.g., the circled region) was positioned proximate the side outlet. Each of FIGS. 8A and 8B show the relevant substrate, as well as a close-up portion of the relevant substrate. The results in FIG. 8A clearly show the effects of intense impinging flow on the substrate in a region near the side outlet, in line with the electrolyte short circuiting problem described herein. In FIG. 8A, these effects are seen as horizontal rows of distinct, vertically oriented shadows positioned close to one another. These distinct, vertically oriented shadows are not desirable. They represent regions where the impinging flow (e.g., originating from a relevant hole in the ionically resistive element) was more substantial than desired. Where this is the case, the pattern of the holes in the ionically resistive element ends up being "printed" onto the substrate as distinct vertically oriented lines, as shown in FIG. 8A. By contrast, FIG. 8B does not show this same effect. While FIG. 8B does show horizontal rows of shadows, the shadows blend into one another and are not distinct. This indicates that the impinging flow near the side outlet was within a desired range, and also indicates that the electrolyte short circuiting problem has been overcome.

It should be understood that the terms "vertical" and "horizontal" as used in reference to FIGS. 8A and 8B are accurate insofar as the cross flow is provided in the direction shown. If the cross flow were from left-to-right, the effects of the greater-than-desired impinging flow near the side inlet would be observed as vertical rows of distinct horizontally oriented shadows. The horizontal rows of shadows observed in FIGS. 8A and 8B may be a result of the linear ribs positioned on the substrate-facing surface of the ionically resistive element. The effects of these ribs are typically evened out when the substrate is rotated during electroplating, for example because the ribs are about coextensive with the substrate.

Additional Embodiments

The various hardware and method embodiments described above may be used in conjunction with lithographic patterning tools or processes, for example, for the fabrication or manufacture of semiconductor devices, displays, LEDs, photovoltaic panels and the like. Typically, though not necessarily, such tools/processes will be used or conducted together in a common fabrication facility.

Lithographic patterning of a film typically comprises some or all of the following steps, each step enabled with a number of possible tools: (1) application of photoresist on a workpiece, e.g., a substrate having a silicon nitride film formed thereon, using a spin-on or spray-on tool; (2) curing of photoresist using a hot plate or furnace or other suitable curing tool; (3) exposing the photoresist to visible or UV or x-ray light with a tool such as a wafer stepper; (4) developing the resist so as to selectively remove resist and thereby pattern it using a tool such as a wet bench or a spray developer; (5) transferring the resist pattern into an underlying film or workpiece by using a dry or plasma-assisted etching tool; and (6) removing the resist using a tool such as an RF or microwave plasma resist stripper. In some embodiments, an ashable hard mask layer (such as an amorphous carbon layer) and another suitable hard mask (such as an antireflective layer) may be deposited prior to applying the photoresist.

In this application, the terms "semiconductor wafer," "wafer," "substrate," "wafer substrate," and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "plating bath," "bath," and "plating solution" are used interchangeably. The above detailed description assumes the embodiments are implemented on a wafer. However, the embodiments are not so limited. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

Unless otherwise defined for a particular parameter, the terms "about" and "approximately" as used herein are intended to mean±10% with respect to a relevant value.

It is to be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated may be performed in the sequence illustrated, in other sequences, in parallel, or in some cases omitted. Likewise, the order of the above described processes may be changed. Certain references have been incorporated by reference herein. It is understood that any disclaimers or disavowals made in such references do not necessarily apply to the embodiments described herein. Similarly, any features described as necessary in such references may be omitted in the embodiments herein.

The subject matter of the present disclosure includes all novel and nonobvious combinations and sub-combinations of the various processes, systems and configurations, and other features, functions, acts, and/or properties disclosed herein, as well as any and all equivalents thereof.

What is claimed is:

1. A method of dynamically controlling pressure in an electroplating apparatus, the method comprising:

(a) receiving a substrate in the electroplating apparatus, the electroplating apparatus comprising:

a plating chamber configured to contain an electrolyte and an anode while electroplating metal onto the substrate, the substrate being substantially planar, a substrate support configured to support the substrate such that a plating face of the substrate is immersed in the electrolyte and separated from the anode during plating, an ionically resistive element adapted to provide ionic transport through the ionically resistive element during electroplating, wherein the ionically resistive element is a plate comprising a plurality of through-holes, a membrane adapted to provide ionic transport through the membrane during electroplating, an ionically resistive element manifold positioned below the ionically resistive element and above the membrane, and an anode chamber positioned below the membrane and containing the anode;

(b) immersing the substrate in the electrolyte and electroplating material onto the substrate;

(c) removing the substrate from the plating chamber; and (d) during (a)-(c), dynamically controlling a pressure in the anode chamber such that the pressure in the anode chamber is always between about 690-6900 Pascal higher than a pressure in the ionically resistive element manifold.

2. The method of claim 1, wherein the pressure in the anode chamber is higher when electroplating material onto the substrate in (b) compared to when loading or unloading the substrate in (a) or (c).

3. The method of claim 2, wherein: (i) during (a) and (c), the pressure in the anode chamber is between about 690-2070 Pascal and the pressure in the ionically resistive element manifold is between about 0-1380 Pascal and (ii) during (b) when the substrate is being electroplated, the pressure in the anode chamber is between about 1380-4830 Pascal and the pressure in the ionically resistive element manifold is between about 690-4140 Pascal.

4. The method of claim 1, wherein the pressure in the anode chamber is dynamically controlled by varying a flow rate of electrolyte into the anode chamber.

5. The method of claim 4, wherein during (a) and (c), a flow rate of electrolyte through a pump that feeds the anode chamber is between about 0.3-2.0 L/min and during (b) when the substrate is being electroplated, the flow rate of electrolyte through the pump that feeds the anode chamber is between about 1.0-4.0 L/min.

6. The method of claim 4, wherein the flow rate of electrolyte into the anode chamber is dynamically controlled based on a position of the substrate support.

7. The method of claim 4, wherein the electroplating apparatus further comprises a first pressure sensor for determining a pressure in the anode chamber and a second pressure sensor for determining a pressure in the ionically resistive element manifold, wherein the flow rate of electrolyte into the anode chamber is dynamically controlled based a difference between the pressure in the anode chamber determined by the first pressure sensor and the pressure in the ionically resistive element manifold determined by the second pressure sensor.

8. The method of claim 1, wherein the pressure in the anode chamber is dynamically controlled by varying a restriction on electrolyte leaving the anode chamber.

9. The method of claim 8, wherein the restriction on electrolyte leaving the anode chamber is varied by dynamically controlling a position of a valve that affects the electrolyte leaving the anode chamber.

10. The method of claim 1, wherein during (a)-(c), the pressure in the anode chamber is between about 690-1380 Pascal higher than a pressure in the ionically resistive element manifold.

11. An apparatus for electroplating, the apparatus comprising:

a plating chamber configured to contain an electrolyte and an anode while electroplating metal onto a substrate, the substrate being substantially planar;

a substrate support configured to support the substrate such that a plating face of the substrate is immersed in the electrolyte and separated from the anode during plating;

an ionically resistive element adapted to provide ionic transport through the ionically resistive element during electroplating, wherein the ionically resistive element is a plate comprising a plurality of through-holes;

a membrane adapted to provide ionic transport through the membrane during electroplating;

an ionically resistive element manifold positioned below the ionically resistive element and above the membrane;

an anode chamber positioned below the membrane and containing the anode; and a controller configured with instructions to perform the following operation: dynamically control a pressure in the anode chamber when electrolyte is present in the anode chamber to thereby maintain the pressure in the anode chamber between about 690-6900 Pascal higher than a pressure in the ionically resistive element manifold.

12. The apparatus of claim 11, wherein the controller is configured with instructions to perform the following operation: dynamically control the pressure in the anode chamber such that a first anode chamber pressure is established during electroplating and a second anode chamber pressure is established when the substrate is being loaded or unloaded from the substrate support, the first anode chamber pressure being greater than the second anode chamber pressure.

13. The apparatus of claim 12, wherein the controller is configured with instructions to perform the following operation: cause a dynamic pressure in the ionically resistive element manifold, such that a first ionically resistive element manifold pressure is established during electroplating and a second ionically resistive element manifold pressure is established when the substrate is being loaded or unloaded from the substrate support, the first ionically resistive element manifold pressure being greater than the second ionically resistive element manifold pressure, wherein the first ionically resistive element manifold pressure is between about 690-4140 Pascal, the second ionically resistive element manifold pressure is between about 0-1380 Pascal, the first anode chamber pressure is between about 1380-4830 Pascal, and the second anode chamber pressure is between about 690-2070 Pascal.

14. The apparatus of claim 11, wherein the pressure in the anode chamber is dynamically controlled by varying a flow rate of electrolyte into the anode chamber.

15. The apparatus of claim 14, wherein the controller is configured with instructions to perform the following operation: cause an electrolyte flow rate through a pump feeding the anode chamber to be (i) between about 0.3-2.0 L/min when the substrate is being loaded or unloaded from the substrate support, and (ii) between about 1.0-4.0 L/min during electroplating.

16. The apparatus of claim 14, wherein the controller is configured with instructions to perform the following operation: dynamically control the flow rate of electrolyte into the anode chamber based on a position of the substrate support.

17. The apparatus of claim 14, further comprising:

a first pressure sensor for determining the pressure in the anode chamber; and a second pressure sensor for determining the pressure in the ionically resistive element manifold, wherein the controller is configured with instructions to perform the following operation: dynamically control the flow rate of electrolyte into the anode chamber based on a difference between the pressure in the anode chamber determined by the first pressure sensor and the pressure in the ionically resistive element manifold determined by the second pressure sensor.

18. The apparatus of claim 11, wherein the controller is configured with instructions to perform the following operation: dynamically control the pressure in the anode chamber by varying a restriction on electrolyte leaving the anode chamber.

19. The apparatus of claim 18, wherein the controller configured with instructions to dynamically control the pressure in the anode chamber by varying a restriction on electrolyte leaving the anode chamber is configured with instructions to perform the following operation: control a position of a valve that affects the electrolyte leaving the anode chamber.

20. The apparatus of claim 11, wherein the controller is configured with instructions to perform the following operation: dynamically control the pressure in the anode chamber such that it remains between about 690-1380 Pascal higher than the pressure in the ionically resistive element manifold.

* * * * *